US010342343B2

(12) United States Patent
Su

(10) Patent No.: US 10,342,343 B2
(45) Date of Patent: Jul. 9, 2019

(54) DRAWER PANEL ADJUSTING DEVICE

(71) Applicant: Guangdong XingPeng Industrial Co., Ltd., Jieyang, Guangdong Province (CN)

(72) Inventor: Shu-Peng Su, Jieyang (CN)

(73) Assignee: Guangdong Xingpeng Industrial Co., Ltd., Jieyang (CN)

( * ) Notice: Subject to any disclaimer, the term of this patent is extended or adjusted under 35 U.S.C. 154(b) by 164 days.

(21) Appl. No.: 15/487,604

(22) Filed: Apr. 14, 2017

(65) Prior Publication Data

US 2018/0228287 A1 Aug. 16, 2018

(30) Foreign Application Priority Data

Feb. 16, 2017 (CN) ..... 2017 1 0083049

(51) Int. Cl.

| | |
|---|---|
| ***A47B 88/90*** | (2017.01) |
| ***A47B 88/95*** | (2017.01) |
| ***A47B 88/956*** | (2017.01) |
| *A47B 95/00* | (2006.01) |

(52) U.S. Cl.

CPC ..... *A47B 88/956* (2017.01); *A47B 88/941* (2017.01); *A47B 95/00* (2013.01); *A47B 2088/951* (2017.01); *A47B 2088/952* (2017.01); *A47B 2088/954* (2017.01)

(58) Field of Classification Search

CPC ..... A47B 2088/951; A47B 2088/952; A47B 2088/954; A47B 2088/94; A47B 2088/902; A47B 88/941; A47B 88/956; A47B 88/919

See application file for complete search history.

(56) References Cited

U.S. PATENT DOCUMENTS 4,850,659 A * 7/1989 Rock ..... A47B 88/956 312/263
6,053,593 A * 4/2000 Rock ..... A47B 88/00 312/330.1
8,955,929 B2 2/2015 Holzapfel et al.
(Continued)

FOREIGN PATENT DOCUMENTS

CN 2827132 Y 10/2006
DE 202014101848 U1 7/2014
(Continued)

*Primary Examiner* — Jonathan P Masinick
(74) *Attorney, Agent, or Firm* — Alan D. Kamrath; Mayer & Williams PC

(57) ABSTRACT

A drawer panel adjusting device includes a fixed member, a first movable member, a first adjusting member, a second movable member, and a second adjusting member. The first adjusting member is located between the fixed member and the first movable member. A spiral block on the first adjusting member extends through a gap between two limiting blocks on the fixed member. The second movable member is mounted in an assembling groove of the first movable member. The second movable member includes a second adjusting hole and a guiding block located in the second adjusting hole. The second adjusting member includes an outer periphery having a spiral guiding groove. The second adjusting member extends through the second adjusting hole and is restrained in the assembling groove. The guiding block is engaged in the spiral guiding groove.

6 Claims, 6 Drawing Sheets

(56) References Cited

U.S. PATENT DOCUMENTS

| | | | | |
|---|---|---|---|---|
| 9,039,108 | B2 * | 5/2015 | Feuerstein | A47B 88/427<br>312/334.4 |
| 9,750,345 | B2 * | 9/2017 | Karu | A47B 88/941 |
| 10,188,209 | B2 * | 1/2019 | Hoffmann | A47B 88/95 |
| 2014/0312756 | A1 | 10/2014 | Ng | |
| 2017/0265645 | A1 * | 9/2017 | Kruger | A47B 88/956 |
| 2017/0290425 | A1 * | 10/2017 | Prentner | A47B 88/427 |

FOREIGN PATENT DOCUMENTS

| | | | |
|---|---|---|---|
| EP | 2774509 | A1 | 9/2014 |
| WO | WO2009059652 | A2 | 5/2009 |

* cited by examiner

DRAWER PANEL ADJUSTING DEVICE

CROSS REFERENCE TO RELATED APPLICATIONS

The application claims the benefit of China application serial No. 201710083049.1, filed on Feb. 16, 2017, and the entire contents of which are incorporated herein by reference.

BACKGROUND OF THE INVENTION

1. Field of the Invention

The present invention generally relates to a part for a drawer and, more particularly, to a drawer panel adjusting device mounted to a front end of a drawer.

2. Description of the Related Art

In general, every drawer includes a bottom board, a front panel, a rear board, and two side boards. The front panel and the rear board are mounted to front and rear ends of the bottom board, and the two side boards are mounted to the left and right sides of the bottom board, together defining a space having an open top end for receiving articles.

With the improvement of the quality of life in the past few years, people are no longer merely satisfied with the utility of the furniture. The critical factor for people purchasing furniture is the sense of quality presented by the details of the furniture. However, even if the furniture with drawers is made with good material and impeccable color, the overall sense of quality of the furniture is decreased if the panels of the drawers cannot align precisely.

Therefore, many furniture manufacturers have dedicated to research on various board connecting mechanisms permitting adjustment of the position of the front panel during installation of each drawer, such that the front panel can move upward/downward relative to the other boards to present drawers substantially at the same height. An example of such a mechanism is disclosed in Chinese Patent Publication No. 2827132. However, mechanisms permitting adjustment of the front panel in the left/right direction are not seen. Improvement is, thus, necessary.

SUMMARY OF THE INVENTION

It is therefore the primary objective of this invention to provide a drawer panel adjusting device which permits the front panel of each drawer of the furniture to move upward, downward, rightward, and leftward relative to other boards to precisely align the front panels of all drawers of the furniture.

When the terms "front", "rear", "left", "right", "up", "down", "inner", "outer", "side", "vertical", "horizontal", and similar terms are used herein, it should be understood that these terms have reference only to the structure shown in the drawings as it would appear to a person viewing the drawings and are utilized only to facilitate describing the invention, rather than restricting the invention.

A drawer panel adjusting device according to the present invention includes a fixed member having two limiting blocks spaced from each other by a gap. A first movable member includes a first adjusting hole and an assembling groove. A first adjusting member includes a first side having a first control portion and a second side having a spiral block. A spacing between the spiral block and a central axis of the first adjusting member gradually increases from an end of the spiral block toward the other end of the spiral block. The first adjusting member is located between the fixed member and the first movable member. The first control portion is received in the first adjusting hole. The spiral block extends through the gap between the two limiting blocks. A second movable member is mounted in the assembling groove. The second movable member includes a second adjusting hole and a guiding block located in the second adjusting hole. A second adjusting member includes a side having a second control portion. The second adjusting member includes an outer periphery having a spiral guiding groove. The second adjusting member extends through the second adjusting hole and is restrained in the assembling groove. The guiding block is engaged in the spiral guiding groove.

The drawer panel adjusting device according to the present invention provides a simple structure that can easily be operated to adjust the position of a front panel of a drawer, such that the front panel can move upward, downward, leftward, or rightward relative to a bottom board and a side board of the drawer to align with the front panels of other drawers, improving the overall sense of quality of the furniture.

In an example, the first movable member includes a main board. The first adjusting hole is defined in a side of the main board. The assembling groove is defined in the other side of the main board. This structure is simple and is easy to manufacture and assemble, reducing the manufacturing costs and increasing the assembling convenience.

In an example, the second movable member includes an engaging groove. The first movable member further includes an extension board and a clamping board. The extension board is connected to the main board. The clamping board is fixed to the extension board. An elastic element and an engaging unit are clamped between the clamping board and the extension board. The elastic element abuts the engaging unit. The engaging unit is pivotable to engage with the engaging groove of the second movable member. This structure permits the second movable member to be rapidly and securely assembled and positioned to the first movable member, increasing the convenience and efficiency of assembly.

In an example, the engaging unit includes a push plate and an insertion plate. The push plate includes a push end insertable into the assembling groove. The insertion plate includes an abutting end and an insertion end opposite to the abutting end. An end of the elastic element abuts the abutting end. The push plate is pivotable to disengage the push end from the assembling groove. The insertion end of the insertion plate is inserted into the engaging groove. This structure is simple and is easy to manufacture and assemble, reducing the manufacturing costs and increasing the assembling convenience.

In an example, the push plate includes a first pivotal hole and a through-hole. The insertion plate further includes a second pivotal hole. A pin extends through the first pivotal hole of the push plate and the second pivotal hole of the insertion plate into a longitudinal limiting hole of the extension board. The through-hole of the push plate remains aligned with a horizontal limiting hole of the extension board. This structure is simple and is easy to manufacture and assemble, reducing the manufacturing costs and increasing the assembling convenience.

In an example, the first adjusting member further includes a stopper block. The stopper block is spaced from the spiral block and is located outside of the spiral block. The stopper block limits the rotational extent of the first adjusting member to avoid excessive rotation of the first adjusting member that may lead to disengagement from the two limiting blocks and subsequent reassembly.

The present invention will become clearer in light of the following detailed description of illustrative embodiments of this invention described in connection with the drawings.

DETAILED DESCRIPTION OF THE INVENTION

Figure 1:
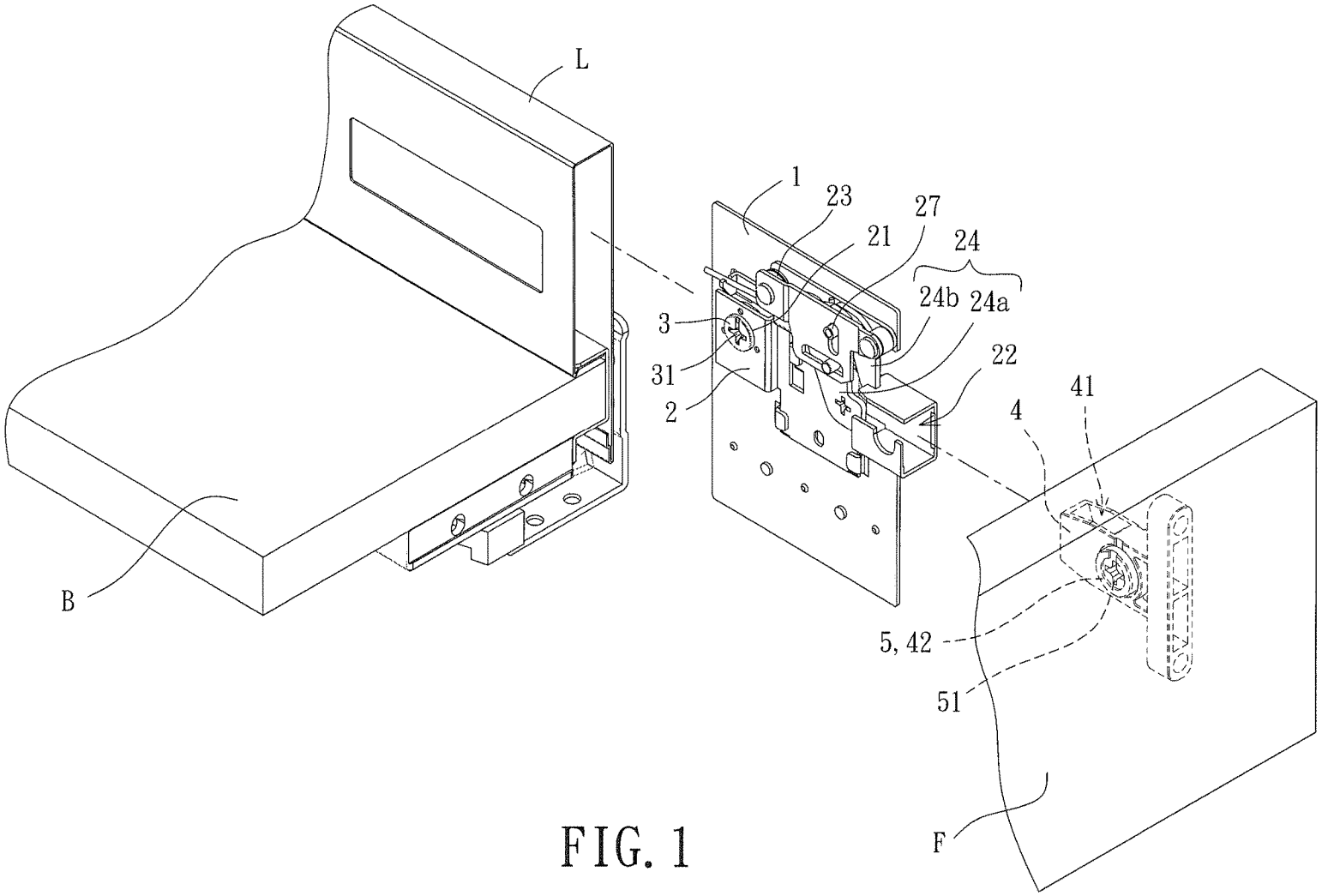
FIG. 1 is an exploded, perspective view of a drawer panel adjusting device of an embodiment according to the present invention, a front panel, a bottom board, and a side board of a drawer.
Figure 2:
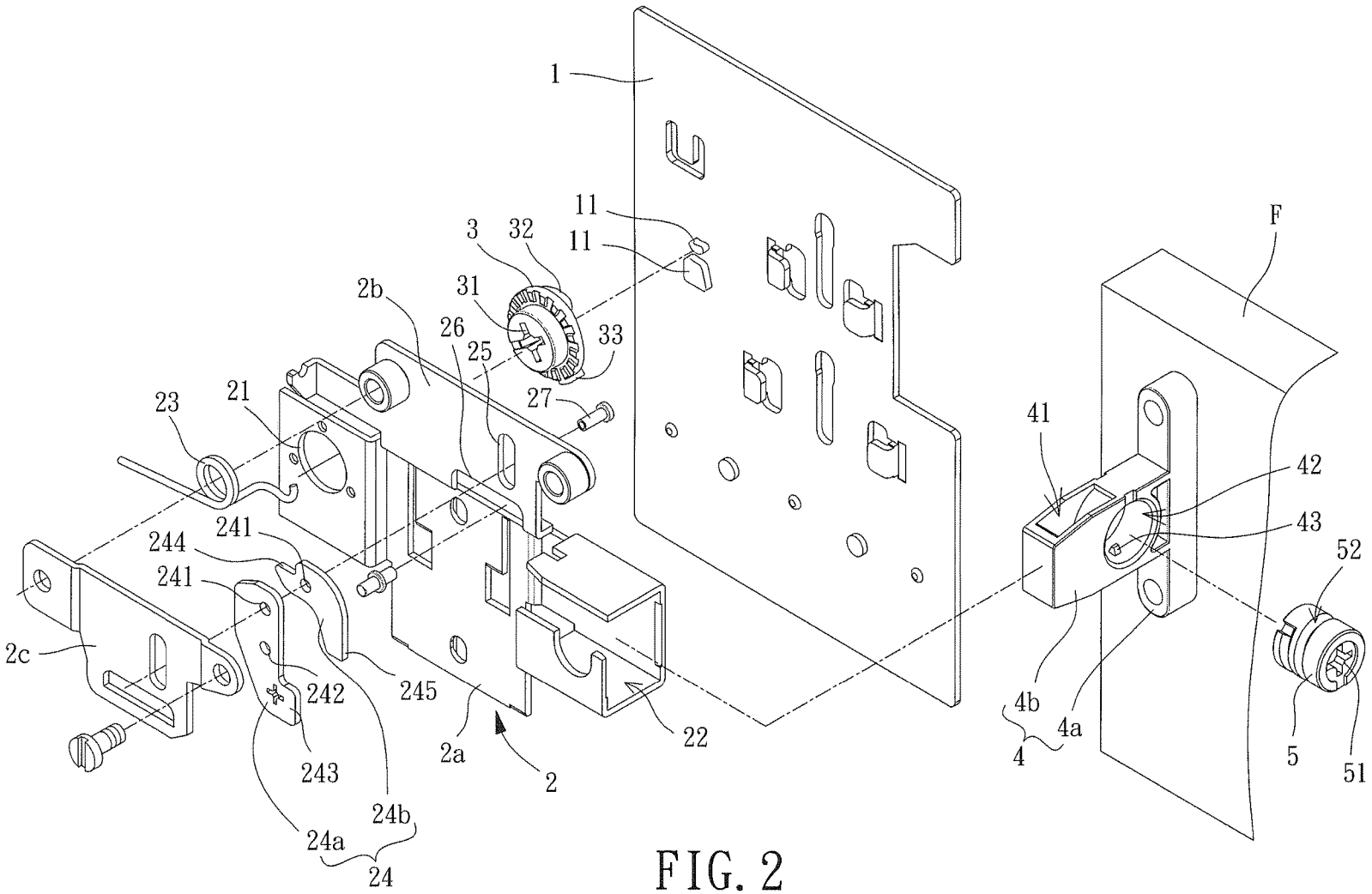
FIG. 2 is an exploded, perspective view of the drawer panel adjusting device of FIG. 1.

With reference to FIGS. 1 and 2, a drawer panel adjusting device of an embodiment according to the present invention includes a fixed member 1, a first movable member 2, a first adjusting member 3, a second movable member 4, and a second adjusting member 5. The first adjusting member 3 is mounted between the fixed member 1 and the first movable member 2. When the first adjusting member 3 is rotated, the first movable member 2 moves upward or downward relative to the fixed member 1. A front panel F of a drawer is fixed to the second movable member 4. The second movable member 4 is assembled to the first movable member 2. The second adjusting member 5 is mounted in the second movable member 4. When the second adjusting member 5 is rotated, the second movable member 4 moves leftward or rightward relative to the first movable member 2.

Specifically, the fixed member 1 extends into a side board L of the drawer and is fixed to a bottom board B of the drawer. The fixed member 1 is used to directly or indirectly mount other components. The fixed member 1 includes two limiting blocks 11 spaced from each other by a gap. More limiting blocks 11 can be provided according to need.

The first movable member 2 includes a first adjusting hole 21 and an assembling groove 22 for mounting the first adjusting member 3 and the second movable member 4, respectively. In this embodiment, the first movable member 2 includes a main board 21. The first adjusting hole 21 is defined in a side of the main board 2*a*. The assembling groove 22 is defined in the other side of the main board 2*a*.

Figure 5:
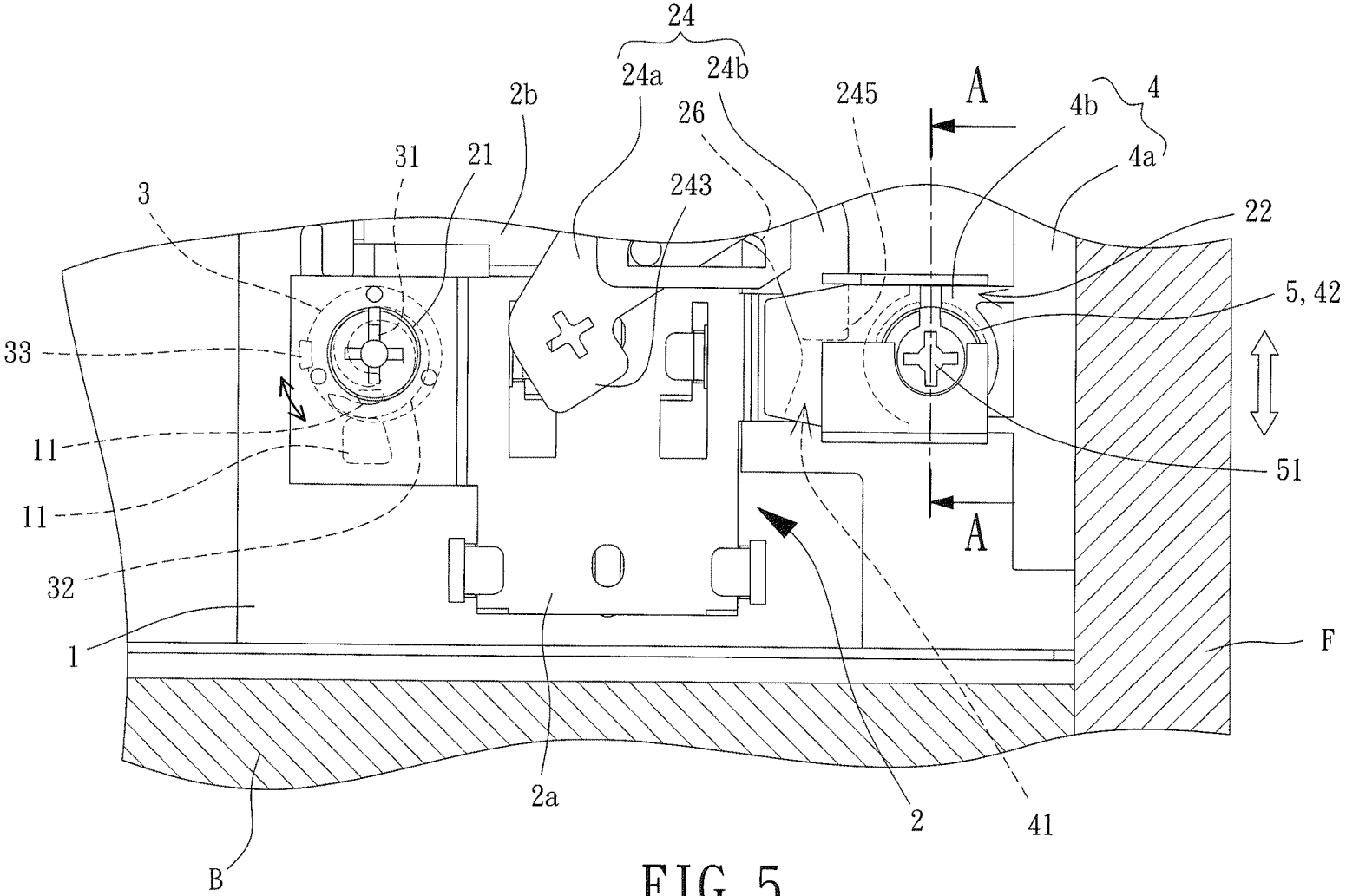
FIG. 5 is an enlarged cross sectional view of a portion of the drawer panel adjusting device of FIG. 1.

With reference to FIGS. 2 and 5, the first adjusting member 3 includes a first side having a first control portion 31. The first control portion 31 can be in the form of a minus-shaped groove or a cruciform groove, such that a screwdriver bit with a flat head or a Phillips head can be inserted into the first control portion 31 and can drive the first adjusting member 3 to rotate. The first adjusting member 3 further includes a second side having a spiral block 32. A spacing between the spiral block 32 and a central axis of the first adjusting member 3 gradually increases from an end of the spiral block 32 toward the other end of the spiral block 32. The first adjusting member 3 is located between the fixed member 1 and the first movable member 2. The first control portion 31 is received in the first adjusting hole 21. The spiral block 32 extends through the gap between the two limiting blocks 11. The first adjusting member 3 further includes a stopper block 33 spaced from and located outside of the spiral block 32. When the first adjusting member 3 is rotated to a predetermined position, the stopper block 33 abuts a lower one of the two limiting blocks 11 to avoid excessive rotation of the first adjusting member 3 that may lead to disengagement from the two limiting blocks 11 and subsequent reassembly.

The second movable member 4 includes a fixed section 4*a* and an insertion section 4*b*. The fixed section 4*a* is fixed to the front panel F of the drawer. The insertion section 4*b* is connected to an end of the fixed section 4*a* and is positioned in the assembling groove 22 of the first movable member 2. Thus, the second movable member 4 and the front panel F can move jointly with the first movable member 2 relative to the fixed member 1.

Figure 3:
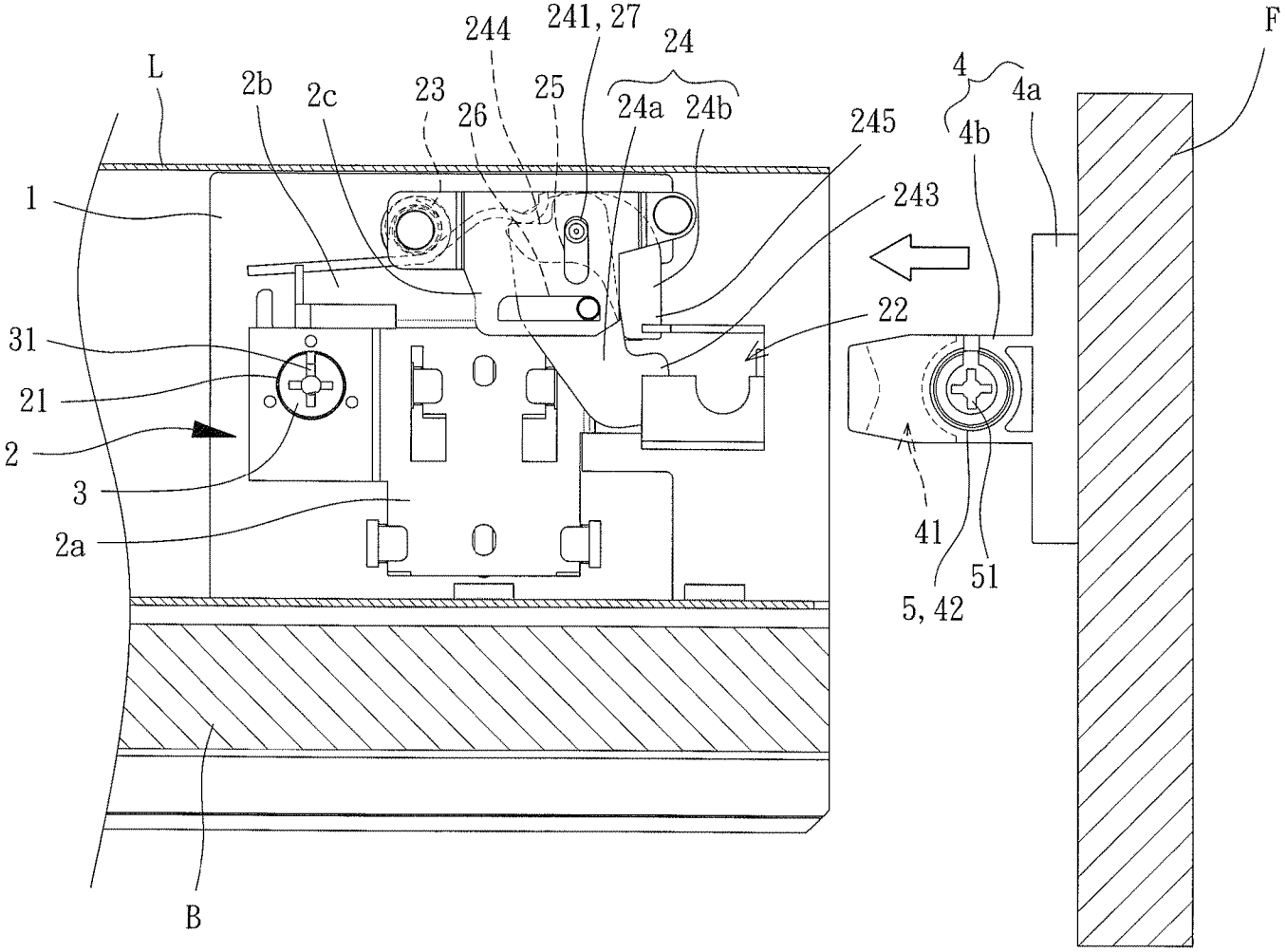
FIG. 3 is a cross sectional view of the drawer panel adjusting device of FIG. 1 before assembly.

With reference to FIGS. 2 and 3, the insertion section 4*b* includes an engaging groove 41 to permit the insertion section 4*b* to conveniently extend into and be positioned in the assembling groove 22. The first movable member 2 includes an extension board 2*b* and a clamping board 2*c*. The extension board 2*b* is connected to an upper end of the main board 2*a*. The clamping board 2*c* is fixed to the extension board 2*b*. An elastic element 23 and an engaging unit 24 are clamped between the clamping board 2*c* and the extension board 2*b*. The elastic element 23 abuts the engaging unit 24. The engaging unit 24 is pivotable to engage with the engaging groove 41 of the second movable member 4.

In this embodiment, the engaging unit 24 includes a push plate 24*a* and an insertion plate 24*b*. The push plate 24*a* includes a first pivotal hole 241 and a through-hole 242. The push plate 24*a* further includes a push end 243 insertable into the assembling groove 22. The insertion plate 24*b* includes a second pivotal hole 241. The insertion plate 24*b* further includes an abutting end 244 and an insertion end 245 opposite to the abutting end 244. A pin 27 extends through the first pivotal hole 241 of the push plate 24*a* and the second pivotal hole 241 of the insertion plate 24*b* into a longitudinal limiting hole 25 of the extension board 2*b*. The through-hole 242 of the push plate 24*a* remains aligned with a horizontal limiting hole 26 of the extension board 2*b*.

With reference to FIG. 3, when the engaging unit 24 is in an initial position, the push end 243 of the push plate 24*a* extends into the assembling groove 22 of the first movable member 2. An end of the elastic element 23 abuts the abutting end 244 of the insertion plate 24*b*.

Figure 4:
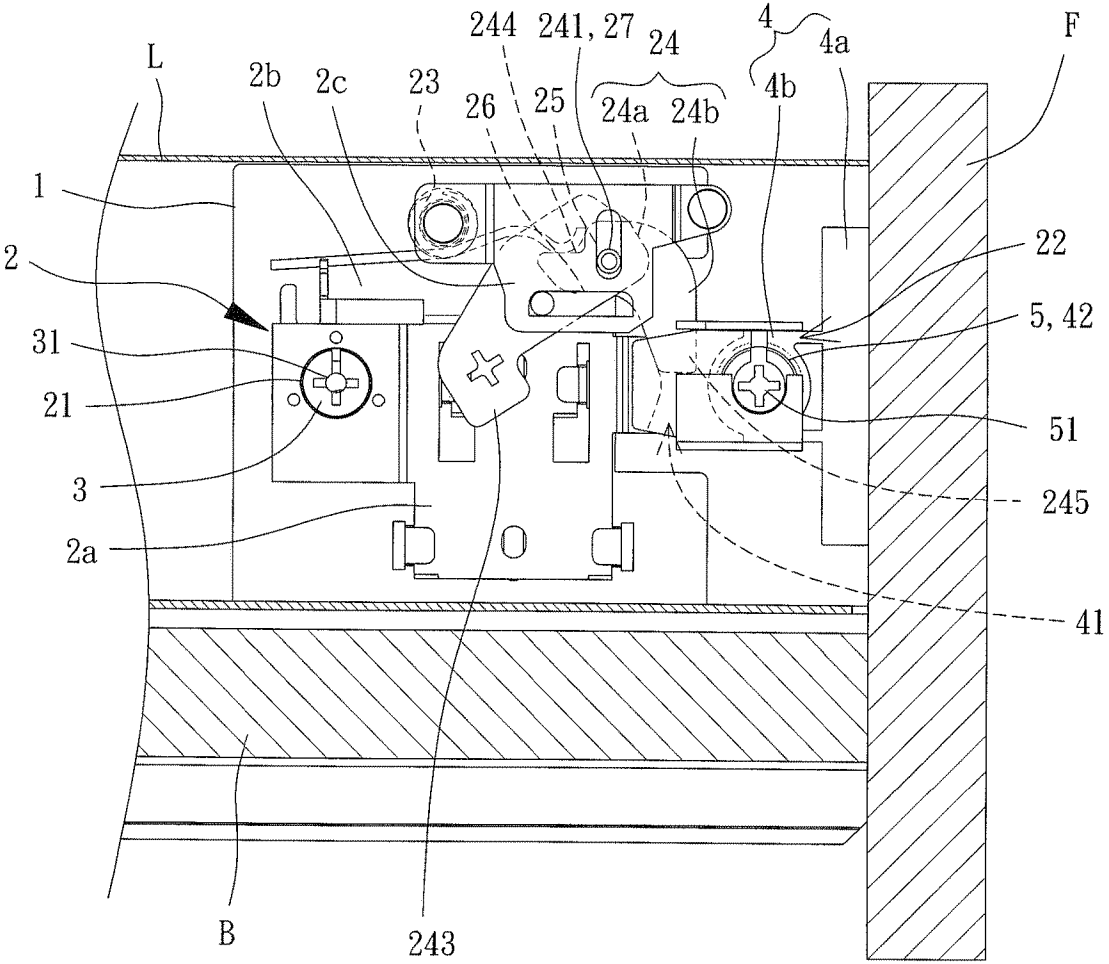
FIG. 4 is a cross sectional view of the drawer panel adjusting device after assembly.

With reference to FIG. 4, when the insertion section 4*b* of the second movable member 4 is inserted into the assembling groove 22, the free end of the insertion section 4*b* pushes the push end 243 of the push plate 24*a* out of the assembling groove 22, causing pivotal movement of the push plate 24*a*. The pin 27 moves downward along the longitudinal limiting hole 25 to synchronously move the insertion plate 24*b* downward. Furthermore, the elastic element 23 elastically presses the insertion plate 24*b* downward to move the insertion end 245 of the insertion plate 24*b* into the assembling groove 22 and the engaging groove 41 of the insertion section 4*b*. Thus, the second movable member 4 is rapidly engaged with and positioned on the first movable member 2.

Figure 6:
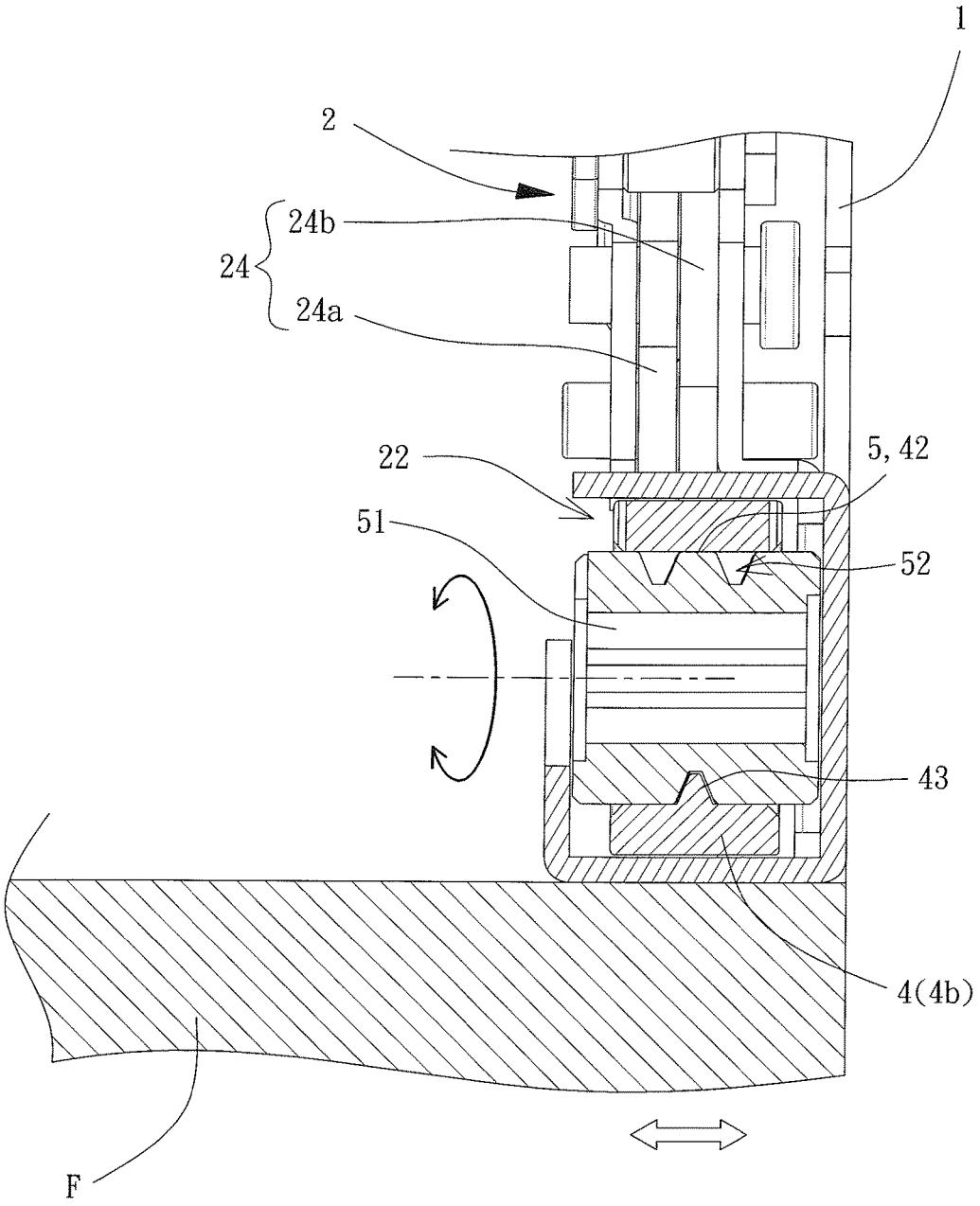
FIG. 6 is a cross sectional view taken along section line A-A of FIG. 5.

With reference to FIGS. 2 and 6, the second movable member 4 further includes a second adjusting hole 42 and a guiding block 43 located in the second adjusting hole 42.

The second adjusting member 5 includes a side having a second control portion 51 for driving the second adjusting member 5 to rotate. The second adjusting member 5 includes an outer periphery having a spiral guiding groove 52. The second adjusting member 5 extends through the second adjusting hole 42 and is restrained in the assembling groove 22. The guiding block 43 of the second movable member 4 is engaged in the spiral guiding groove 52.

With reference to FIGS. 4 and 5, according to the above structure, after the drawer panel adjusting device has been assembled with the front panel F, the bottom board B, and the side board L, if the upper and lower edges of the front panel F of the drawer are not aligned with the upper and lower edges of the front panel F of an adjacent drawer, a user can operate the first control portion 31 of the first adjusting member 3 from inside of the side board L to rotate the first adjusting member 3, such that the spacing between the spiral block 32 and the central axis of the first adjusting member 3 is gradually changed to abut one of the two limiting blocks 11 by different positions. During this procedure, the first movable member 2 gradually moves upward or downward relative to the fixed member 1 to actuate the second movable member 4 (fixed on the first movable member 2) and the front panel F (fixed on the second movable member 4) to synchronously move upward or downward until the upper and lower edges of the front panel F of the drawer are aligned with the upper and lower edges of the front panel F of the adjacent drawer.

With reference to FIGS. 2 and 6, when the left and right edges of the front panel F of the drawer are not aligned with the left and right edges of the front panel F of an adjacent drawer, the second control portion 51 of the second adjusting member 5 can be operated from inside of the side board L to rotate the second adjusting member 5, such that the engaging position of the guiding block 43 of the second movable member 4 in the spiral guiding groove 52 is changed. Thus, the second movable member 4 is movable relative to the second adjusting member 5 along a longitudinal direction of the second adjusting member 5. As a result, the second movable member 4 and the front panel F can move leftward or rightward relative to the fixed member 1 and the first movable member 2 until the left and right edges of the front panel F of the drawer are aligned with the left and right edges of the front panel F of the adjacent drawer.

In view of the foregoing, the drawer panel adjusting device according to the present invention provides a simple structure that can easily be operated to adjust the position of the front panel F, such that the front panel F can move upward, downward, leftward, or rightward relative to the bottom board B and the side board L to align with the front panels F of other drawers, improving the overall sense of quality of the furniture.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A drawer panel adjusting device, comprising:

a fixed member including two limiting blocks spaced from each other by a gap;

a first movable member including a first adjusting hole and an assembling groove;

a first adjusting member including a first side having a first control portion and a second side having a spiral block, with a spacing between the spiral block and a central axis of the first adjusting member gradually increasing from an end of the spiral block toward another end of the spiral block, with the first adjusting member located between the fixed member and the first movable member, with the first control portion received in the first adjusting hole, with the spiral block extending through the gap between the two limiting blocks;

a second movable member mounted in the assembling groove, with the second movable member including a second adjusting hole and a guiding block located in the second adjusting hole; and a second adjusting member including a side having a second control portion, with the second adjusting member including an outer periphery having a spiral guiding groove, with the second adjusting member extending through the second adjusting hole and restrained in the assembling groove, and with the guiding block engaged in the spiral guiding groove.

2. The drawer panel adjusting device as claimed in claim 1, wherein the first movable member includes a main board, wherein the first adjusting hole is defined in a side of the main board, and wherein the assembling groove is defined in another side of the main board.

3. The drawer panel adjusting device as claimed in claim 2, wherein the second movable member includes an engaging groove, wherein the first movable member further includes an extension board and a clamping board, wherein the extension board is connected to the main board, wherein the clamping board is fixed to the extension board, wherein an elastic element and an engaging unit are clamped between the clamping board and the extension board, wherein the elastic element abuts the engaging unit, and wherein the engaging unit is pivotable to engage with the engaging groove of the second movable member.

4. The drawer panel adjusting device as claimed in claim 3, wherein the engaging unit includes a push plate and an insertion plate, wherein the push plate includes a push end insertable into the assembling groove, wherein the insertion plate includes an abutting end and an insertion end opposite to the abutting end, wherein an end of the elastic element abuts the abutting end, wherein the push plate is pivotable to disengage the push end from the assembling groove, and wherein the insertion end of the insertion plate is inserted into the engaging groove.

5. The drawer panel adjusting device as claimed in claim 4, wherein the push plate includes a first pivotal hole and a through-hole, wherein the insertion plate further includes a second pivotal hole, wherein a pin extends through the first pivotal hole of the push plate and the second pivotal hole of the insertion plate into a longitudinal limiting hole of the extension board, and wherein the through-hole of the push plate remains aligned with a horizontal limiting hole of the extension board.

6. The drawer panel adjusting device as claimed in claim 1, wherein the first adjusting member further includes a stopper block, wherein the stopper block is spaced from the spiral block and is located outside of the spiral block.

* * * * *